United States Patent [19]

Fukushima et al.

[11] 4,310,777

[45] Jan. 12, 1982

[54] DIRECTLY HEATED CATHODE FOR ELECTRON TUBE

[75] Inventors: Hiroshi Fukushima, Chiba; Ko Soeno; Hisashi Ando, both of Hitachi; Shigehiko Yamamoto, Tokorozawa; Toshiyuki Aida, Chofu, all of Japan

[73] Assignee: Hitachi, Ltd., Tokyo, Japan

[21] Appl. No.: 110,920

[22] Filed: Jan. 10, 1980

[30] Foreign Application Priority Data

Jan. 19, 1979 [JP] Japan ..... 54-3955

[51] Int. Cl.[3] ..... H01J 1/14

[52] U.S. Cl. ..... 313/345; 313/311; 313/346 R

[58] Field of Search ..... 313/345, 346 R, 311, 313/213, 218, 346, 346 DC

[56] References Cited

U.S. PATENT DOCUMENTS

| | | | |
|---|---|---|---|
| 4,079,164 | 3/1978 | Misumi | 313/345 |
| 4,220,891 | 9/1980 | Ando et al. | 313/346 |
| 4,260,665 | 4/1981 | Aida et al. | 313/346 |

FOREIGN PATENT DOCUMENTS

| | | |
|---|---|---|
| 44-21008 | | Japan . |
| 52-108770 | 9/1977 | Japan . |

*Primary Examiner*—Saxfield Chatmon, Jr.
*Attorney, Agent, or Firm*—Craig and Antonelli

[57] ABSTRACT

A directly heated cathode for an electron tube comprising a base plate made of an alloy containing 20 to 30% by weight of W, 0.12 to 0.28% by weight of Zr and the remainder being Ni and an electron emissive oxide layer disposed directly on the base plate shows good and stable electron emission properties and when it is installed in a television picture tube, the picture tube shows excellent initial properties.

7 Claims, 6 Drawing Figures

DIRECTLY HEATED CATHODE FOR ELECTRON TUBE

Figure 1:
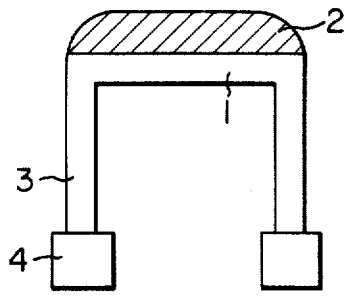

This invention relates to a directly heated cathode for an electron tube comprising a thin base plate made of a Ni-W-Zr alloy having a special amount of Zr and an electron emissive oxide layer directly disposed on the base plate.

In order to shorten a time required for the appearance of an image on a television picture tube after switching on a television set (a rise time), a so-called preheating method has widely been used previously in which a low electric current is always passed through a heater of an indirectly heated cathode for the television picture tube even during a non-operating period. But from the viewpoint of saving energy, the development of television picture tubes having a short rise time without using the preheating method has recently been demanded strongly. The rise time of indirectly heated cathodes could be shortened from about 20 seconds (without preheating) to about 5 seconds by improving the indirectly heated cathodes, but there is no prospect for shortening it to about 1 second contrary to the case of the preheating method. The use of a directly heated cathode which can lessen heat capacity comparing with a calorific value in place of the indirectly heated cathode may be thinkable, but there are many problems for practical use of the directly heated cathode.

The directly heated cathode for an electron tube comprises a base plate (or base metal plate) made of a heat resistant metal and a layer of electron emissive oxides such as alkaline earth metal oxides disposed on the flat portion of the base plate, and electrons are emitted from the oxides by heating the flat portion of the base plate by passing directly an electric current via terminals of the base plate. Major properties required for the base plate of the cathode are as follows: (a) sufficient electron emission properties can be maintained stably for a long period of time and electron emission after 20,000 hours should be 60% or more of the initial value, (b) deformation of the flat portion during the operation should be within 4 μm, (c) no delamination of the alkaline earth metal oxide layer takes place, (d) electric resistivity should be large at about 800° C., preferably 80 μΩ-cm or more, in order to be a resistor which can be heated by passing an electric current, (e) the base plate has good cold workability and can be rolled to a plate of 50 μm or less and variation of the thickness can be controlled within 5%, etc.

Many prior art references refer to directly heated cathodes. For example, Japanese Patent Appln Kokoku (Post-Exam Publn) No. 21008/69 discloses the use of a Ni-W alloy containing an impurity amount of a reducing agent such as Mg, Si, Al, Zr, etc. for producing the base plate of the cathode. But since the amount of Zr is as low as an impurity amount, the objected effect of Zr cannot be obtained by causing undesirable phenomena, e.g. coloring on the phosphor screen of a color television picture tube taking place on switching on a television set. U.S. Pat. No. 4,079,164 discloses the use of a Ni-W alloy containing Zr in an amount of 0.3 to 5% by weight, and if required together with a small amount of Mg, Al, Si, or the like, for producing the base plate of the cathode. But since the Zr content is 0.3% by weight or more, there are produced intermetallic compounds of Zr, which are hardly distributed in the base plate uniformly, so that there take place undesirable phenomona, e.g. electron emission becomes non-uniform, production of reduced Ba in the so-called oxide layer on the surface of the cathode becomes excessive, which results in increasing stray emission, and the like. Japanese Patent Appln Kokai (Laid-Open) No. 108770/77 discloses a process for producing a directly heated cathode comprising forming a layer made of an alloy of Ni-W-Zr (Zr content 0 to 1.5% by weight on the surface of a base metal plate made of an alloy of Ni-W-Zr (Zr content 0.1 to 1.5% by weight), placing Ni powder on the layer made of Ni-W-Zr alloy (Zr content 0 to 1.5% by weight), sintering the Ni powder with heating on the layer, and forming an electron emissive layer thereon. But according to this process, since the Ni-W-Zr alloy layer should be formed on the base metal plate and further Ni powder should be placed on said layer, the production process becomes complicated and the form of Ni powder is easily changed; these are not preferable. In addition, the present inventors have measured thermionic emission properties of these cathodes mentioned above and initial properties of television picture tubes installing these cathodes and found that there are many problems to be solved. For example, when a Ni-W alloy is used for the base metal in a cathode, the tungsten reacts with alkaline earth metal compounds, particularly with Ba, to form an interface layer of tungsten in the course of the decomposition of alkaline earth metal carbonates placed on the base metal plate to the alkaline earth metal oxides. If the decomposition temperature is low, tungstates are hardly produced and thermionic emission is stable but the initial properties are low. If the decomposition temperature is raised in order to improve the initial properties, there are produced a large amount of tungstates, which are reduced by Zr to form interface layer substances of Zr (e.g. $BaZrO_3$). In such a case, if the amount of Zr in the base metal is large, produced amounts of interface layer substances of Zr also increase, which results in causing undesirable phenomena such as deterioration of thermionic emission, stray emission, and the like.

It is an object of this invention to provide a directly heated cathode for an electron tube showing excellent initial properties when installed in a television picture tube and having stable thermionic emission properties for a long period of time.

This invention provides a directly heated cathode for an electron tube comprising a base plate made of an alloy containing 20 to 30% by weight of W, 0.12 to 0.28% by weight of Zr and the remainder being Ni and an electron emissive oxide layer disposed directly on the base plate.

Figure 2:
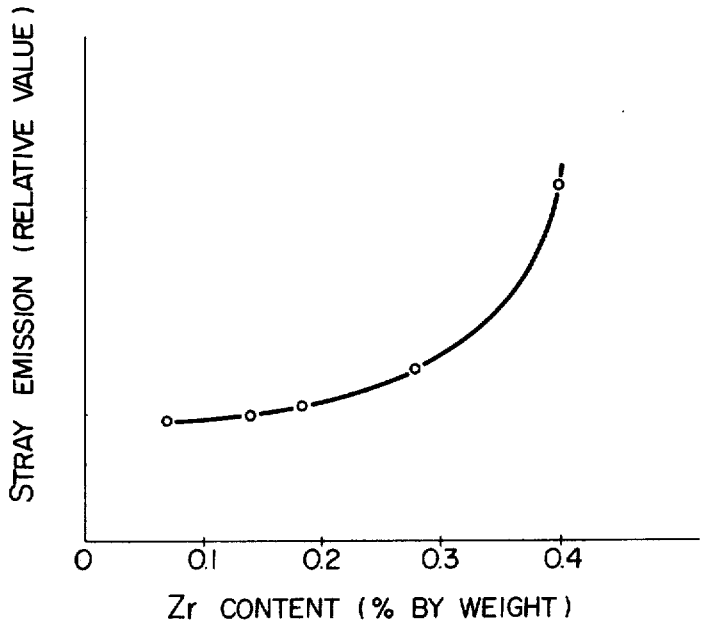
Figure 3:
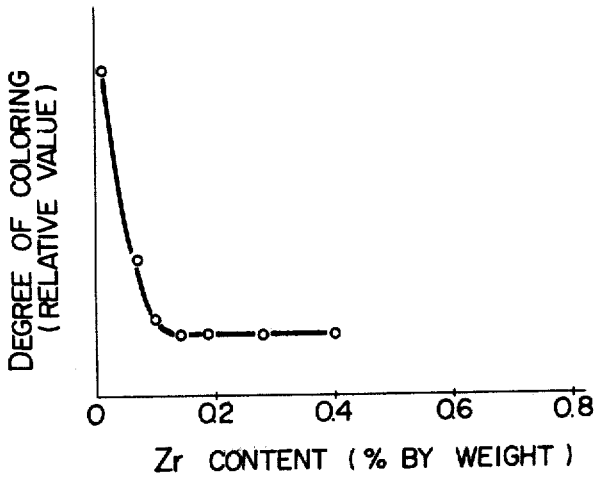
Figure 4:
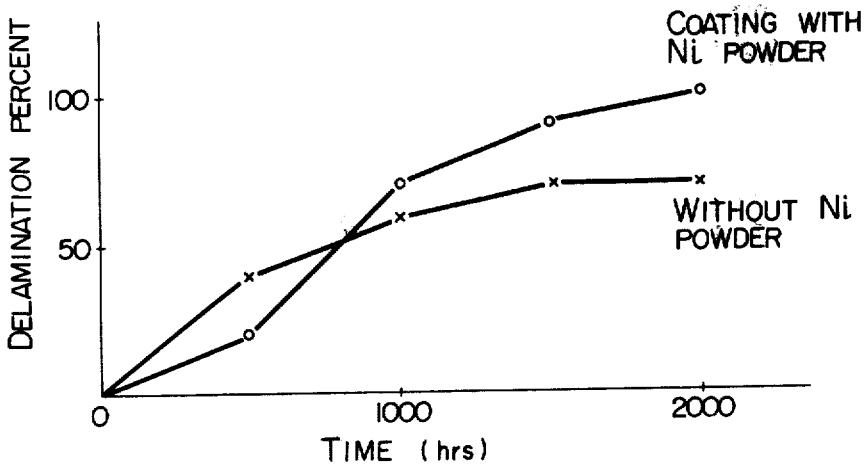

In the attached drawings, FIG. 1 is a cross-sectional view of one example of a cathode of this invention, FIG. 2 is a graph showing the relationship between the Zr content and stray emission, FIG. 3 is a graph showing the relationship between the Zr content and degree of coloring of the phosphor screen, FIG. 4 shows changes of delamination percents with the lapse of time, and FIGS. 5 (a) and (b) show changes of electron emission with the lapse of time.

As shown in FIG. 1, the cathode of this invention comprises a base plate having a flat portion 1 and a foot portion 3 connected to a terminal 4 and an electron emissive oxide layer 2 directly disposed on the flat portion 1 of the base plate. The electron emissive oxide layer 2 is formed by coating alkaline earth metal carbonates such as $(Ba.Sr.Ca)CO_3$ on the base plate and heating them in an electron tube under vacuum at a time of exhausting the air to produce the corresponding oxides as is well known in the art. The cathode of this invention is suitable for the production under higher decomposition temperature of the carbonates in order to improve the initial properties of television picture tubes.

The base plate should be made of an alloy containing 20 to 30% by weight of W, 0.12 to 0.28% by weight of Zr and the remainder being Ni. It is well known in the art that a Ni-W alloy containing 20 to 30% by weight of W is suitable for producing the base plate of directly heated cathodes from the viewpoints of electrical resistance, mechanical properties, heat resistance, and the like. The amount of W is limited by the following reasons. If the amount of W is less than 20% by weight, resistivity at 800° C. becomes less than 80 $\mu\Omega$-cm and the cathode temperature during the operation is varied due to the influence of contact resistance between the pin and the socket, which results in easily lowering thermionic emission properties. Further, if the amount of W is less than 20% by weight, high temperature strength at 800° C. is lowered and there easily take place changes of electron tube properties due to the deformation of the cathode. On the other hand, if the amount of W is more than 30% by weight, there are formed intermetallic compounds of Ni and W, which lower cold workability and cracks are easily produced by slight working.

The Ni-W-Zr alloy used for producing the base plate can suitably be produced by a conventional powder metallurgy process. Since a specific gravity of W is larger than that of Ni and a melting point of W is higher than that of Ni, when such an alloy is produced by a conventional melting process, it is difficult to form a uniform molten metal, and even if a uniform molten metal is formed, W may be segregated at a time of solidification, and if the molten metal is cooled rapidly in order to prevent the segregation of W, cracks may be generated. There are no such problems when the powder metallurgy process is employed. Sintering of the material can be carried out in vacuum, e.g. $5\times10^{-5}$ Torr, at about 1350° C., for example, in order to prevent oxidation of the material. The resulting sintered material is subjected to at least one cold rolling and at least one vacuum annealing to give a thin plate material. From the resulting thin plate material of, for example, about 40 $\mu$m thick, the base plate having a prescribed form is stamped out and the foot portions 3 are bent. On the flat portion 1 of the base plate, the alkaline earth metal carbonates are coated, for example, by spraying. The resulting cathode is installed in an electron tube, sealed and the air is exhausted by a conventional method. During the exhaustion of air, the base metal plate is heated by directly passing an electric current therethrough to decompose the carbonates to the corresponding oxides by means of a conventional method.

As mentioned above, the Ni-W-Zr alloy used for producing the base plate of the directly heated cathode is characterized by containing Zr in an amount of 0.12 to 0.28% by weight. When a layer of $(Ba.Sr.Ca)CO_3$ is disposed on the base metal plate by using a conventional method and decomposed to the corresponding oxides, there are produced BaO and $Ba_3WO_6$. The amount of $Ba_3WO_6$ produced increases with an increase of the decomposition temperature. $Ba_3WO_6$ is further reacted with Zr in the aging step after the decomposition step or during the operation of a color television picture tube after installing the cathode therein to produce $BaZrO_3$ and Ba. On the other hand, BaO is also reacted with Zr in the aging step after the decomposition step or during the operation of a color television picture tube after installing the cathode thererein to produce Ba and $BaZrO_3$ ($3BaO+Zr=BaZrO_3+2Ba$). If the decomposition temperature is raised in order to improve the initial properties of the picture tube, the amount of $Ba_3WO_6$ produced increases, and if the Zr content is large in such a case, the amounts of Ba and $BaZrO_3$ produced increase as mentioned above. The thus produced Ba will adhere to electrodes such as a first grid, a second grid, etc., in the picture tube and electrons are emitted therefrom. Such electrons irradiate places other than the prescribed place, for example, white light which should be so originally is tinged with red, to produce a phenomenon of so-called stray emission. The relationship between the Zr content in the base metal and stray emission (relative values) is as shown in FIG. 2. As is clear from FIG. 2, if the Zr content is more than 0.3% by weight, considerably high values of stray emission are obtained. Therefore, from the viewpoint of improving the initial properties of the picture tube, the Zr content should be 0.28% by weight or less. On the other hand, although the production of interface layer substances of Zr (e.g. $BaZrO_3$) and stray emission decrease with a decrease of the Zr content, if the Zr content becomes too little, degree of coloring of the television picture tube increases rapidly as shown in FIG. 3. Coloring of the television picture tube means a phenomenon which takes place in the case of switching on a color television picture tube which has three cathodes and that the image area which should be white originally is tinged with other colors such as red caused by the generation of deviation of electron emissive abilities of individual cathodes due to deviation of temperature rising speeds of individual cathodes. From the results shown in FIG. 3, the lower limit of the Zr content should be 0.12% by weight. Taking the improvement of the initial properties of the picture tube into consideration, more preferable Zr content is in the range of 0.14 to 0.22% by weight.

In the cathode for an electron tube, adhesive strength between the base metal plate and the oxide layer is important. Particularly when an interface layer of Zr or W is formed, the adhesive strength is lowered. For evaluating the adhesiveness of the oxide layer and the base metal plate, there is a method of disassembling an electron tube after operating under conventional conditions, taking out the cathode, scratching the surface of the oxide layer of the cathode with a pin crosswisely and observing the state of delamination of the oxide layer. If the adhesiveness is good, only crosswise scratches are produced, while if the adhesiveness is bad, delamination is produced. Adhesiveness is evaluated in this invention by a ratio of an area delaminated to the whole area in such a case as mentioned above. FIG. 4 shows the results obtained by carrying out the adhesiveness test by employing the scratching method as mentioned above but conducting an accelerating test by charging a cathode at a voltage of 120% of the rating value and by using a cathode prepared by placing Ni powder on the surface of a base metal plate made of an alloy containing W 28% by weight, Zr 0.18% by weight and Ni remainder, sintering the Ni powder and coating an oxide layer by using a conventional method and another cathode which is prepared in the same way as mentioned above except for not placing Ni powder and not sintering it. As shown in FIG. 4, the cathode in which Ni powder is coated and sintered shows a good result only in a short initial period, whereas the cathode in which the oxide layer is disposed directly on the base metal plate without using Ni powder shows a good result after the lapse of a long period of time. It seems that the above-mentioned results are obtained by the progress of deformation of the sintered Ni powder due to dispersion of the Ni into the base metal with the lapse of time.

Figure 5A:
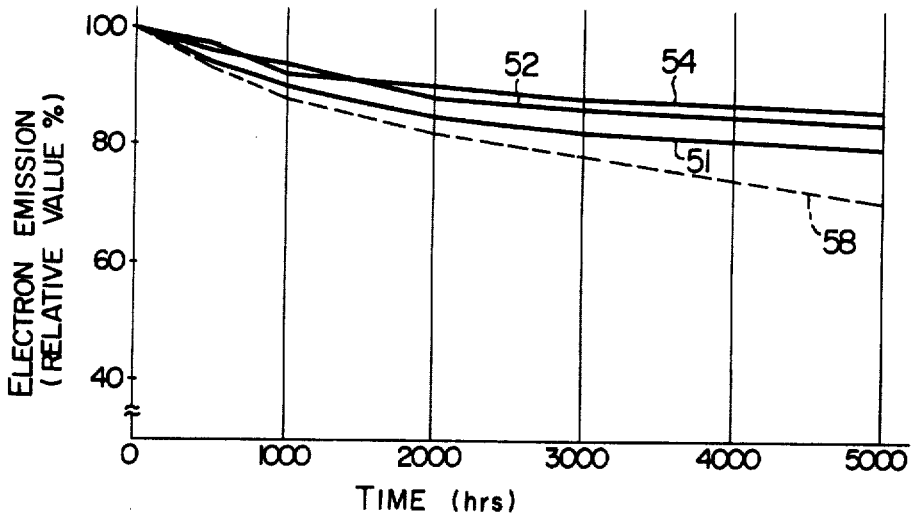
Figure 5B:
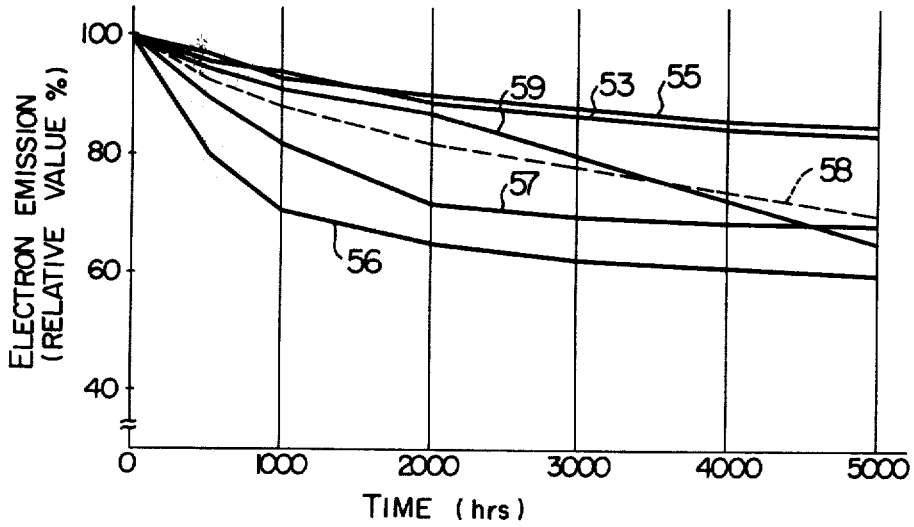

Changes of electron emission properties of cathodes made by changing the Zr content in the base metal, said cathodes being installed in electron tubes by using a conventional method and operated under usual conditions, are measured with the lapse of time. The results are as shown in FIGS. 5(a) and 5(b). In these drawings, the operation time is taken on an abscissa axis and the electron emission (relative value in %) is taken on an ordinate axis. In these drawings, individual curve numbers show that the base metal plates are made of alloys having the following compositions:

| Curve No. | Ni | W | Zr | (% by weight) |
|---|---|---|---|---|
| 51 | 71.99 | 28 | 0.01 | |
| 52 | 71.93 | 28 | 0.07 | |
| 53 | 71.86 | 28 | 0.14 | |
| 54 | 71.82 | 28 | 0.18 | |
| 55 | 71.72 | 28 | 0.28 | |
| 56 | 71.6 | 28 | 0.4 | |
| 57 | 71.6 | 28 | 0.4 | |
| 58 | — | — | — | (indirectly heated cathode: Mg.0.07%, Ni remainder) |
| 59 | 71.86 | 28 | 0.14 | + Ni powder coating |

The decomposition temperature of the alkaline earth metal carbonates to the oxides is 1000° C.

As shown in FIG. 5(b), when the Zr content becomes as large as 0.4% by weight, deviation of electron emission properties appears. Further when Ni powder is placed on the base metal plate and sintered and thereafter the oxide layer is disposed thereon, deterioration of electron emission properties appears remarkably after the operation of 3000 hours. This seems to be caused by deformation of the sintered Ni due to dispersion of the Ni.

As mentioned above, television picture tubes installing the directly heated cathode of this invention show excellent initial properties and short rise time and the electron emission properties are stable and good over 5000 hours, so that the directly heated cathode of this invention can sufficiently be put to practical use.

What is claimed is:

1. A directly heated cathode for an electron tube comprising a base plate made of an alloy containing 20 to 30% by weight of W, 0.12 to 0.28% by weight of Zr and the remainder being Ni and an electron emissive oxide layer disposed directly on the base plate.

2. A directly heated cathode according to claim 1, wherein the Zr content is 0.14 to 0.22% by weight.

3. A directly heated cathode according to claim 1, wherein the Zr content is 0.18% by weight.

4. A directly heated cathode according to claim 1, wherein the base plate is made of an alloy containing 28% by weight of W, 0.18% by weight of Zr, and the remainder being Ni.

5. A directly heated cathode according to claim 1, wherein said alloy is produced by a powder metallurgy process.

6. A base plate for a directly heated cathode, said base plate being adapted to have a layer of electron emissive oxides disposed directly thereon when used as the base plate of a directly heated cathode, said base plate being made of an alloy containing 20 to 30% by weight of W, 0.12 to 0.28% by weight of Zr and the remainder being Ni.

7. A base plate for a directly heated cathode according to claim 6, wherein said alloy contains 0.14–0.22% by weight Zr.

* * * * *